US005247282A

United States Patent [19]

Marshall

[11] Patent Number: 5,247,282

[45] Date of Patent: Sep. 21, 1993

[54] DELIVERY SIGNAL AND APPLIANCE CONTROL SYSTEM

[76] Inventor: Sharron Marshall, 2709 Linda Dr., Ennis, Tex. 75119-7617

[21] Appl. No.: 804,919

[22] Filed: Dec. 11, 1991

[51] Int. Cl.[5] ..... G08B 13/14

[52] U.S. Cl. ..... 340/569; 232/35; 340/310 R; 340/539

[58] Field of Search ..... 340/569, 539, 310 R; 232/34, 35

[56] References Cited

U.S. PATENT DOCUMENTS 4,163,225 7/1979 Engel ..... 340/569
4,287,514 9/1981 Wartman ..... 340/569
5,036,310 7/1991 Russell ..... 340/569

*Primary Examiner*—Jin F. Ng
*Assistant Examiner*—Christine K. Oda
*Attorney, Agent, or Firm*—Kenneth A. Roddy

[57] ABSTRACT

A delivery signal and appliance control system generates audible or visual signal within a dwelling to indicate that a delivery, such as a newspaper or piece of mail has been deposited in a remote delivery container, such as a mailbox, and also controls current through electrical wall receptacles inside the dwelling to operate appliances responsive to the delivery. The system has a delivery notification switch at the remote delivery container which is connected to a control box in the dwelling. The control box is connected to dedicated electrical wall receptacles into which electrical appliances may be plugged. The control box has a DC circuit activated by the delivery notification switch upon receipt of an article being deposited in the delivery container to generate an audible or visual signal and to control an AC circuit which allows electrical current through the dedicated electrical receptacles to provide electrical power to electrical appliances plugged into the receptacles. Optionally a radio frequency signal transmitter may be connected to the control box to generate a radio frequency signal which is received by a radio frequency receiver remote from the control box.

13 Claims, 2 Drawing Sheets

DELIVERY SIGNAL AND APPLIANCE CONTROL SYSTEM

BACKGROUND OF THE INVENTION

1. Field of the Invention

This invention relates generally to article delivery signaling systems, such as mailbox delivery signal devices, and more particularly to a delivery signal and appliance control system which signals that a delivery has been made and performs the additional function of controlling current through electrical wall receptacles inside a dwelling to operate appliances upon activation of the delivery signal.

2. Brief Description of the Prior Art

There are several patents which disclose various article delivery signaling systems, such as mailbox delivery signal devices which signal that a delivery has been made.

Harms, U.S. Pat. No. 393,558 discloses an electric letter box wherein an electrical circuit is closed during the lifting of the letter box cover necessary to insert the mail into the box and sounds an alarm which may be remote from the letter box.

Vaughn, U.S. Pat. No. 1,639,581 discloses a mail box having a pivoted closure that is activated by a carrier when depositing mail into or on the mailbox to close an electrical circuit which sounds a signal and also operates an indicator arranged within the dwelling that visually indicates that mail has been delivered.

Lowe et al, U.S. Pat. No. 4,314,102 discloses a computerized post office box monitoring system wherein a post office box holder calls a telephone number which accesses a computer. The computer indicates the presence or absence of mail in a plurality of mail boxes. The caller is notified if the particular box referred to contains mail by a series of tone pulses.

The U.S. Patents to Conigliaro (U.S. Pat. No. 3,611,333), Huang (U.S. Pat. No. 4,520,350), and Benages (U.S. Pat. No. 4,872,210) disclose electric mail indicator systems comprising a radio signal transmitter at the mailbox which sends out signal when the mailbox door is opened or closed. A radio receiver in the residence intercepts the signal and converts it to either an audible or visual signal, or both.

The present invention is distinguished over the prior art in general, and these patents in particular by a delivery signal and appliance control system which generates an audible or visual signal within a dwelling to indicate that a delivery, such as a newspaper or piece of mail has been deposited in a remote delivery container, such as a mailbox, and also controls current through electrical wall receptacles inside the dwelling to operate appliances responsive to the delivery. The system has a delivery notification switch at the remote delivery container which is connected to a control box in the dwelling. The control box is connected to dedicated electrical wall receptacles into which electrical appliances may be plugged. The control box has a DC circuit activated by the delivery notification switch upon receipt of an article being deposited in the delivery container to generate an audible or visual signal and to control an AC circuit which allows electrical current through the dedicated electrical receptacles to provide electrical power to electrical appliances plugged into the receptacles. Optionally a radio frequency signal transmitter may be connected to the control box to generate a radio frequency signal which is received by a radio frequency receiver remote from the control box.

SUMMARY OF THE INVENTION

It is therefore an object of the present invention to provide a delivery signal system which will signal a person within a dwelling that a delivery, such as a newspaper or piece of mail has been made to a delivery container, such as a mailbox.

It is another object of this invention is to provide a provide a delivery signal system which will generate a radio frequency signal to a receiver at a remote location to indicate that a delivery has been made.

Another object of this invention to provide a delivery signal and appliance control system which will not only signal a person within a dwelling that a delivery, such as a newspaper or piece of mail has been made but will also control current through electrical wall receptacles inside the dwelling to operate appliances upon activation of the delivery.

Another object of this invention is to provide a delivery signal and appliance control system which will signal a person within a dwelling that a newspaper or piece of mail has been delivered and to wake them up and start their coffee pot or other appliances responsive to the delivery.

A further object of this invention is to provide a provide a delivery signal system which will eliminate the necessity of having to physically check to see if a delivery, such as a newspaper or piece of mail has been made.

A still further object of this invention is to provide a delivery signal and appliance control system which is simple in construction, economical to manufacture, and safe and reliable in operation.

Other objects of the invention will become apparent from time to time throughout the specification and claims as hereinafter related.

The above noted objects and other objects of the invention are accomplished by a delivery signal and appliance control system which generates an audible or visual signal within a dwelling to indicate that a delivery, such as a newspaper or piece of mail has been deposited in a remote delivery container, such as a mailbox, and also controls current through electrical wall receptacles inside the dwelling to operate appliances responsive to the delivery. The system has a delivery notification switch at the remote delivery container which is connected to a control box in the dwelling. The control box is connected to dedicated electrical wall receptacles into which electrical appliances may be plugged. The control box has a DC circuit activated by the delivery notification switch upon receipt of an article being deposited in the delivery container to generate an audible or visual signal and to control an AC circuit which allows electrical current through the dedicated electrical receptacles to provide electrical power to electrical appliances plugged into the receptacles. Optionally a radio frequency signal transmitter may be connected to the control box to generate a radio frequency signal which is received by a radio frequency receiver remote from the control box.

DESCRIPTION OF THE PREFERRED EMBODIMENT

For ease of understanding, a brief overview of the preferred delivery signal and appliance control system will first be described with reference to FIG. 1, then a followed by a more detailed description of the system and its operation.

Figure 1:
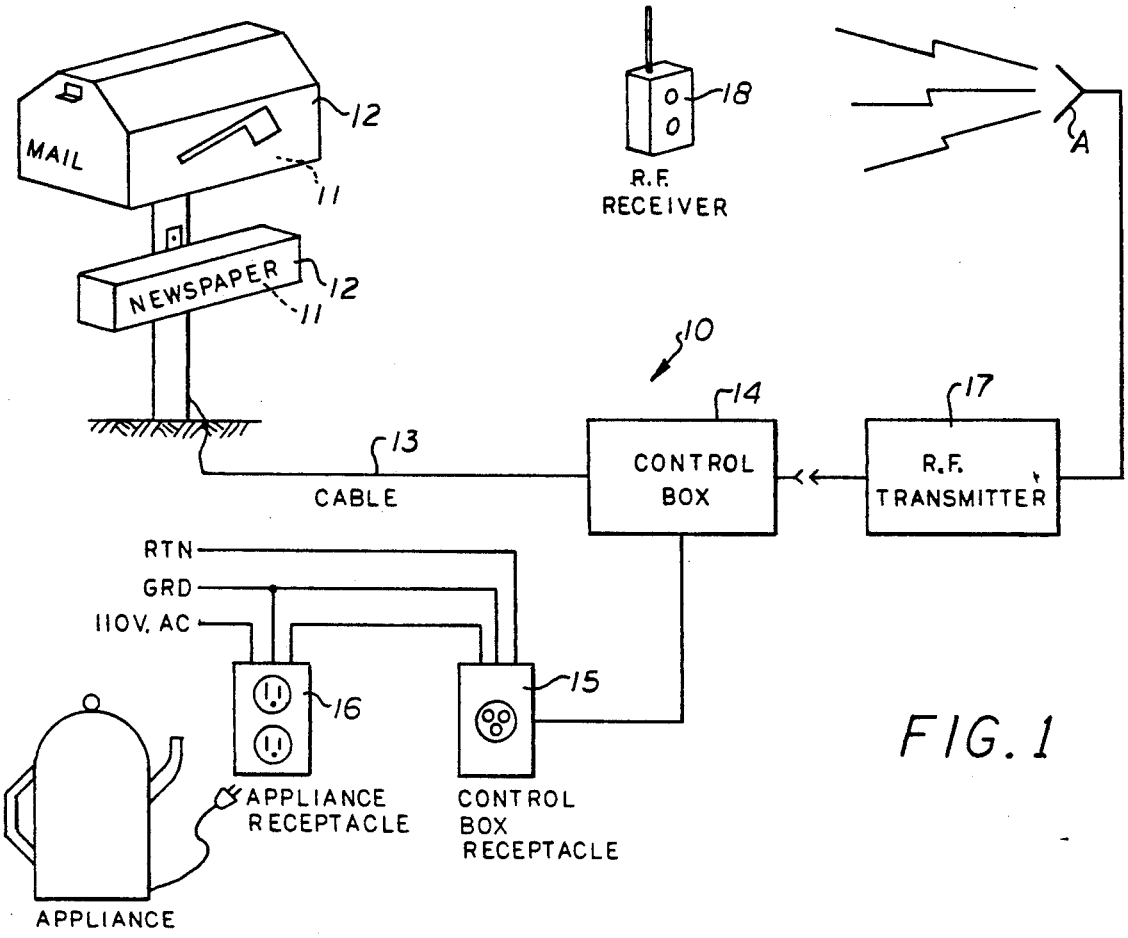
FIG. 1 is a schematic illustration of the delivery signal and appliance control system in accordance with the present invention.

Referring to the drawings by numerals of reference, there is shown schematically in FIG. 1, a preferred delivery signal and appliance control system 10. A delivery notification switch mechanism 11 is connected to a mailbox or other delivery container 12 which will receive articles to be delivered. The switch mechanism 11 is connected by wire or cable 13 to a control box 14 which is located within a dwelling and contains electrical signal and control circuitry. The control box 14 is connected to dedicated, specially wired, AC electrical wall receptacles which are disposed at selective locations within the dwelling. For example, the control box 14 may be located in the master bedroom and plugged into a dedicated AC control box receptacle 15 in the master bedroom which is also wired to a dedicated AC appliance receptacle 16 in the kitchen.

Optionally, a RF transmitter 17 may be connected to the control box 14 to transmit a RF signal which is intercepted by remote RF receiver 18 to signal a person in a remote location (outside the dwelling), that a delivery has been made.

Figure 3:
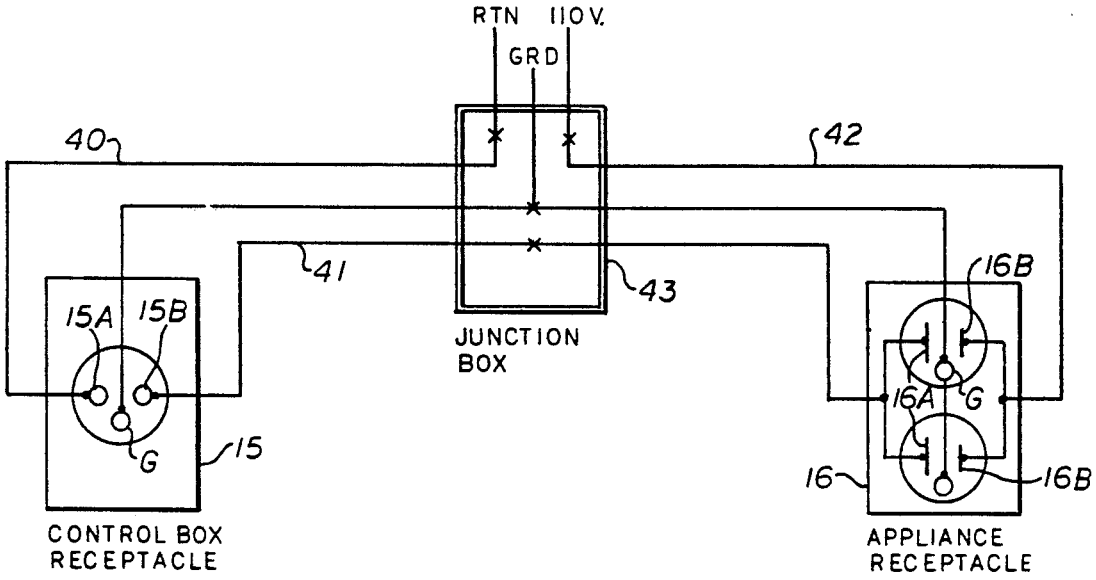
FIG. 3 is a schematic illustration of the wiring of the electrical wall receptacles located in a dwelling and controlled by the control circuitry of the delivery signal and appliance control system.
Figure 2:
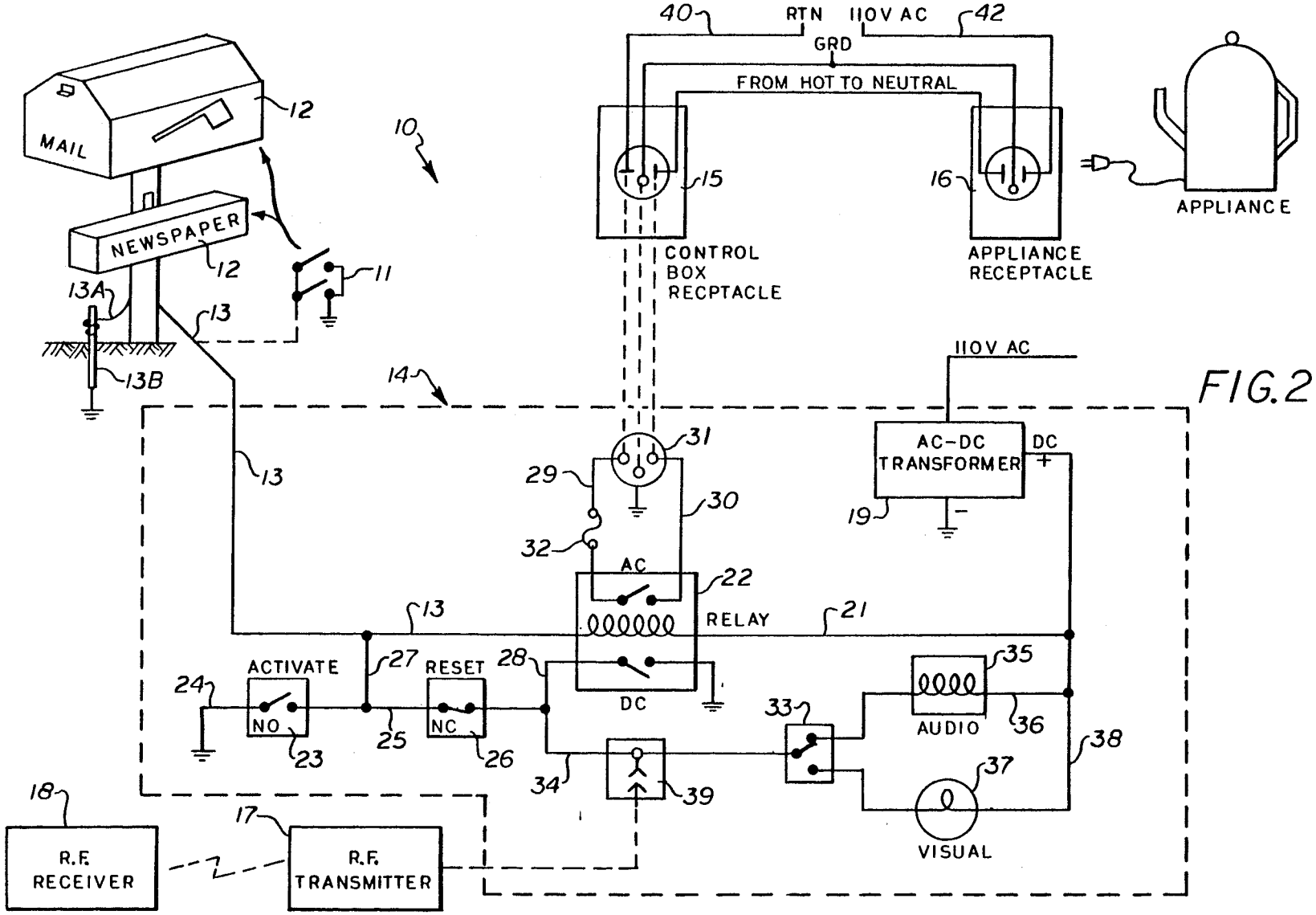
FIG. 2 is a schematic illustration of the control circuitry of the delivery signal and appliance control system.

Referring now additionally to the schematic diagrams of FIGS. 2 and 3, a more detailed description of the preferred delivery signal and appliance control system will be undertaken. As seen in FIG. 2, the portion of the circuit within the dashed lines represents the circuitry within the control box 14.

The delivery notification switch 11 which is connected to the mailbox or other suitable delivery container 12, is conventional in the art. Suitable delivery switches may be of various types such as a mechanical switch, gravity-sensitive switch, or light-sensitive switch. The wire or cable 13 extending from the delivery container 12 to the dwelling may be buried underground where applicable or otherwise hidden from view. To span great distances, the wire 13 may also be connected to a fence wire with another lead or wire extending from the fence to the dwelling. The delivery notification switch 11 is activated by a delivery, such a mail or a newspaper, being deposited into the mailbox or delivery container 12.

The control circuitry is powered by DC current, such as 12 volts, provided through an AC/DC transformer 19 in the control box 14 which is plugged into the 110 volt AC house current. The delivery notification switch 11 has one wire 13 which extends to the dwelling and another wire 13A connected to a ground rod 13B. Wire 13 is connected to the winding of a DPST relay 22 and the other wire 13A is grounded. The AC/DC transformer 19 is connected by lead 21 to the winding of the relay 22. A normally open (NO) activate switch 23, such as a momentary push button SPST switch has one terminal connected to ground through lead 24 and its other terminal connected by lead 25 to a normally closed (NC) reset switch 26, such as a momentary push button SPST switch.

A lead 27 is connected to the lead 25 between the activate switch 23 and reset switch 26 and joined to the wire 13B connected to the winding of the relay 22. The other terminal of the reset switch 26 is connected to a contact on one side of the DPST relay 22 by a lead 28 to complete a DC return path. The contacts on the other side of the winding if the DPST relay are connected through leads 29 and 30 to an AC type electrical plug 31 and are isolated from the DC portion of the circuit. A fuse 32 is installed in lead 29 between the relay 22 and the plug 31.

A three-way toggle switch 33 is connected to the DC contacts of the relay 22 by a lead 34. An audible alarm 35, such as a buzzer, is connected to one contact of the toggle switch 33 and to the AC/DC transformer 19 by lead 36 and a visual indicator 37, such as a lamp, is connected to another contact of the toggle switch 33 and to the DC power jack 20 by lead 38. The center position of the toggle switch 33 is the OFF position. Thus, there are three signal modes; an audible alarm, a visual alarm, or "off" which are controlled by the toggle switch 33 on the control box 14.

Optionally, a transmitter jack 39 may be connected in the lead 34 between the relay 22 and the toggle switch 33 into which the RF transmitter 17 may be plugged.

Referring now additionally to FIG. 3, wiring of the dedicated wall receptacles which are controlled by the control box will be described. The dedicated control box receptacle 15 is installed in the dwelling at a convenient location, such as the master bedroom, to receive the plug 31 from the control box 14. For obvious safety reasons, the control box receptacle 15 is the only one into which the control box will be plugged. Other dedicated wall receptacles, or appliance receptacles 16 are installed in the dwelling at selective locations, such as the kitchen. The dedicated receptacles 15 and 16 resemble a conventional AC wall receptacle, but are color coded or otherwise marked to distinguish them over conventionally wired or live AC wall receptacles for safety.

The neutral terminal 15A (usually silver colored) of the control box receptacle 15 is connected by lead 40 to the AC return line (RTN) and its hot terminal 15B (usually gold colored) is connected by lead 41 to the neutral terminal 16A of the dedicated appliance receptacle(s) 16. The hot terminal 16B of the dedicated appliance receptacle(s) 16 is connected by lead 42 to the 110 volt AC house current. The ground terminal G of each receptacle is grounded. As seen in FIG. 3, the wiring modification as described may be accomplished by joining the wires at an existing junction box 43.

OPERATION

The deliver notification switch 11 is placed in the open or trigger condition. The AC/DC transformer 19 of control box 14 is plugged into the 110 volt house current. The AC plug 31 of the control box is plugged into the dedicated control box receptacle 15. Utilizing the toggle switch 33 on the control box, the user selects either an audible alarm, visual alarm, or no alarm (off).

The user also selects one or more appliances to be activated upon the delivery being made, such as a coffee pot, radio, television, lamps, etc. These appliances are plugged into the dedicated appliance wall receptacles 16. The dedicated appliance wall receptacles 16 will be inactive until activated by the control circuit.

When a delivery, such as a piece of mail or a newspaper is deposited into the delivery container 12, the delivery notification switch is moved to the closed position which completes the DC signal circuit through the normally closed reset switch 26, the DC contacts of the relay 22, and the toggle switch 33. If the toggle switch 33 is positioned to activate the audible 35 or visual 37 alarm, the appropriate alarm will be activated by the DC current.

When the DC contacts of the relay 22 are closed, the AC contacts on the other side of the relay winding will be drawn closed to complete the AC circuit through the control box plug 31, the dedicated control box receptacle 15, and through all the dedicated appliance receptacles 16 in the specially wired circuit. When the dedicated appliance receptacles 16 are activated, the appliances plugged into them are provided with 110 volt AC current, assuming that the on/off switch of the appliance is in the "on" position.

Once the relay 22 has been activated, it will stay activated through its own make contacts. To deactivate the control box 14, the reset switch 26 is pushed which removes the DC return path to open the relay contacts. In the event that the user would like to activate the dedicated appliance receptacles during other times, the toggle switch 33 is set to the "off" position and the push button activate switch 23 on the control box is pushed. This will bypass the delivery notification switch 11 and complete the DC circuit through the normally closed reset switch 33 and the DC contacts of the relay 22. In this mode, the dedicated appliance receptacles 16 will remain active until the reset switch 26 is pushed.

Optionally, the RF transmitter 17 may be plugged into the transmitter jack 39. When the DC circuit is completed as previously described, the transmitter 17 will transmit a RF signal via an antenna A to the RF receiver 18 at a remote location. The RF receiver 18 may be carried by a person who is out of the house, or in a vehicle in close proximity to the house. With this option, it is not necessary for a person to be inside the house to be notified when a delivery has been made.

Thus, not only does the present system allow a person to be notified when a delivery, such as the mail or newspaper, has been delivered, but will also allow the delivery of the morning newspaper to wake them up and start their coffee.

While this invention has been described fully and completely with special emphasis upon a preferred embodiment, it should be understood that within the scope of the appended claims the invention may be practiced otherwise than as specifically described herein.

I claim:

1. A delivery signal and appliance control system for activating electrical receptacles and appliances plugged thereinto responsive to delivery of an article comprising;

a delivery container for receiving an article to be delivered, a delivery notification switch operatively connected with said delivery container and movable from an open position to a closed position upon receipt of said article being deposited in said delivery container, control means operatively connected with said delivery notification switch and to a source of DC electrical current, and dedicated electrical receptacles remote from said delivery container operatively connected to a source of AC electrical current and to said control means and into which electrical appliances may be plugged, said control means preventing AC current to flow through said dedicated electrical receptacles when said delivery notification switch is in the open position, said control means being selectively activated by said delivery notification switch moving to the closed position upon receipt of said article being deposited in said delivery container to complete a DC electrical circuit in said control means to allow AC electrical current to flow through said dedicated electrical receptacles and to electrical appliances plugged thereinto.

2. The delivery signal and appliance control system according to claim 1 including;

indicator means remote from said delivery container and operatively connected to said control means for selective operation, said control means being selectively activated by said delivery notification means upon receipt of said article being deposited in said delivery container to cause said indicator means to generate a signal indicating that said article has been deposited in said delivery container.

3. The delivery signal and appliance control system according to claim 2 in which;

said indicator means is an audible signal generator operatively connected to said control means for selective operation.

4. The delivery signal and appliance control system according to claim 2 in which;

said indicator means is a visual signal generator operatively connected to said control means for selective operation.

5. The delivery signal and appliance control system according to claim 2 in which;

said indicator means is a radio frequency signal transmitter operatively connected to said control means for selective operation to generate a radio frequency signal which is received by a radio frequency signal receiver remote from said control means.

6. The delivery signal and appliance control system according to claim 1 including;

bypass means operatively connected to said control means to selectively bypass the operation of said delivery notification switch and activate said control means to allow AC electrical current through said dedicated electrical receptacles and to electrical appliances plugged thereinto regardless of whether said article has been deposited in said delivery container.

7. The delivery signal and appliance control system according to claim 1 in which;

said control means comprises;

a relay having a winding connected to said source of DC electrical current and to said delivery notification switch and having a set of DC contacts on one side of the winding and a set of AC contacts on the other side of the winding, a normally open activate switch and a normally closed reset switch connected in series to the DC contacts of said relay and said delivery notification switch connected between said activate switch and said reset switch to complete a DC circuit upon said activate switch or said delivery notification switch being moved to the closed position to activate said relay, an AC plug connected to said relay AC contacts and adapted for connection to at least one said dedicated electrical receptacle for completing an AC electrical circuit through said dedicated electrical receptacle upon activation of said relay by said delivery notification switch or by said activate switch to provide AC electrical current to electrical appliances plugged thereinto.

8. The delivery signal and appliance control system according to claim 7 in which;

said dedicated electrical receptacles comprise a dedicated control receptacle for receiving said AC plug connected to said relay, and one or more dedicated electrical appliance receptacles into which electrical appliances may be plugged, said dedicated appliance receptacles operatively connected to said dedicated control receptacle to provide AC electrical current to electrical appliances plugged thereinto upon activation of said relay by said delivery notification switch or by said activate switch.

9. The delivery signal and appliance control system according to claim 8 in which;

said dedicated control receptacle has a neutral terminal connected to the neutral line of the source of AC current and a hot terminal connected to a neutral terminal of at least one said dedicated electrical appliance receptacle, said at least one dedicated electrical appliance receptacle has a hot terminal connected to the source of AC current, and each said dedicated control receptacle and said dedicated electrical appliance receptacle has a ground terminal connected to ground.

10. The delivery signal and appliance control system according to claim 7 including;

a signal selection switch connected to said relay DC contacts, an audible signal generator and a visual signal generator connected to said signal selection switch, said signal selection switch capable of being selectively positioned between and "off" position, an "audible" position, and a "visual" position to provide no signal, an audible signal, or a visual signal, respectively, upon activation of said relay to indicate that said article has been deposited in said delivery container.

11. The delivery signal and appliance control system according to claim 7 including;

a RF transmitter jack connected between said relay DC contacts and said signal selection switch for connection of a RF transmitter.

12. The delivery signal and appliance control system according to claim 11 including;

a RF transmitter operatively connected to said RF transmitter jack to provide a RF signal upon activation of said relay capable of being intercepted by a RF receiver to indicate that an article has been deposited in said delivery container.

13. A delivery signal and appliance control system for activating electrical appliances responsive to delivery of an article comprising;

a delivery container for receiving an article to be delivered;

a delivery notification switch operatively connected with said delivery container and movable from an open position to a closed position upon receipt of said article being deposited in said delivery container;

control means including a relay having a winding connected to a source of DC electrical current, a set of DC contacts on one side of the winding, a normally open activate switch and a normally closed reset switch connected in series to the DC contacts, a set of AC contacts on the other side of the winding, and an AC plug connected to said AC contacts, and said delivery notification switch connected between said activate switch and said reset switch to complete a DC circuit upon said activate switch or said delivery notification switch being moved to the closed position to activate said relay;

electrical receptacles remote from said delivery container including a dedicated control receptacle and one or more dedicated electrical appliance receptacles into which electrical appliances are plugged, said dedicated control receptacle having a neutral terminal connected to the neutral line of the source of AC current and a hot terminal connected to a neutral terminal of at least one said dedicated electrical appliance receptacle, said at least one dedicated electrical appliance receptacle having a hot terminal connected to the source of AC current, and each said dedicated control receptacle and said dedicated electrical appliance receptacle having a ground terminal connected to ground;

said relay being connected to said dedicated control receptacle by said AC plug to form an AC electrical circuit through said dedicated electrical receptacles which is completed upon activation of said relay by said delivery notification switch or by said activate switch to allow AC electrical current to flow through said dedicated electrical appliance receptacles and to electrical appliances plugged thereinto.

* * * * *